United States Patent [19]

Wilson

[11] 4,364,553

[45] Dec. 21, 1982

[54] SHEET STACKING APPARATUS

[75] Inventor: Lionel A. Wilson, Redbourn, England

[73] Assignee: Xerox Corporation, Stamford, Conn.

[21] Appl. No.: 201,676

[22] Filed: Oct. 28, 1980

[30] Foreign Application Priority Data

Oct. 31, 1979 [GB] United Kingdom ..... 7937764

[51] Int. Cl.[3] ..... B65H 31/10

[52] U.S. Cl. ..... 271/219; 271/207; 414/99

[58] Field of Search ..... 271/219, 217, 207, 218, 271/215, 214, 213, 220, 208, 209, 211, 160; 414/99

[56] References Cited

U.S. PATENT DOCUMENTS 3,137,499 6/1964 Maidment ..... 271/219 X 4,221,379 9/1980 Kamath et al. ..... 271/289

OTHER PUBLICATIONS

Wing, W. F. "Sheet Receiving Tray," *IBM Technical Disclosure Bulletin,* vol. 17, No. 4, Sep. 1974, p. 1135.

*Primary Examiner*—Bruce H. Stoner, Jr.

[57] ABSTRACT

A sheet stacking apparatus in which resilient strips of plastic material are fixed at one end just below an exit slot of a feed arrangement for sheets or sets of sheets. The strips extend over a catch tray positioned below the exit slot. In use, the strips are deflected by an amount substantially proportional to the weight of sheets in the stack which they partially support, so that the top sheet in the stack is always at substantially the same height above the catch tray base. The leading edges of fed-out sheets or sets always encounter a support surface at a constant position whereby curling or rolling up of fed-out sheets or sets is prevented.

3 Claims, 2 Drawing Figures

SHEET STACKING APPARATUS

BACKGROUND OF THE INVENTION

This invention relates to a sheet stacking apparatus, and is particularly concerned with such an apparatus which comprises a device for feeding sheets or sets of sheets from an exit location into a catch tray positioned below the exit location, and means for supporting sheets or sets fed into the catch tray such that further sheets or sets fed from the exit location will encounter substantially constant stacking conditions.

Sheet stacking apparatus are used in many situations where sheets or sets of sheets are fed out from, for example, printing, photocopying or duplicating machines. In addition to such machines in which single sheets are fed out, various finishing stations, such as binding or stapling stations, may deliver bound or stapled sets of sheets. In machines and finishing stations of the kind mentioned, the sheets, usually of paper, are often passed over or between rollers, and are often heated, which gives the sheets or sets fed out a strong tendency to curl, or even to roll up. Modern machines can often produce large volumes of fed-out sheets or sets, and relatively deep catch trays are needed to accommodate their output. In the absence of anything to prevent it, a first sheet or set being fed from an exit location into a deep catch tray will have to be fed through or fall a much greater distance before it comes to rest on the base of the catch tray than if the catch tray were, for example, almost full with previously-fed sheets or sets. In such circumstances, there is a tendency for the first-fed sheet or sets to curl, or roll up, to the great inconvenience of the user of the machine.

A previous solution to this problem has been to use a catch tray with an elevating base, the base being arranged to keep the top of the stack held in the catch tray at a substantially constant height. One example of such an arrangement may be seen in U.S. Pat. No. 3,458,187 in which a pivotally mounted base is urged upwards by a spring, the spring being compressed in accordance with the weight of sheets held on the base. This solution, although effective, is expensive to implement compared with a simple, fixed catch tray which does not have an elevating base.

SUMMARY OF THE INVENTION

The present invention is intended to provide an improved simple, inexpensive sheet stacking apparatus which is characterized in that the means for supporting sheets or sets fed into the catch tray comprises one or more resilient members mounted adjacent the exit location and extending in the feed direction. The resilient members are arranged to support at least the trailing edges of sheets or sets held in the catch tray and are formed of such material and configuration as to be deflected by an amount substantially proportional to the weight of sheets or sets being supported.

DESCRIPTION OF THE PREFERRED EMBODIMENT

Figure 1:
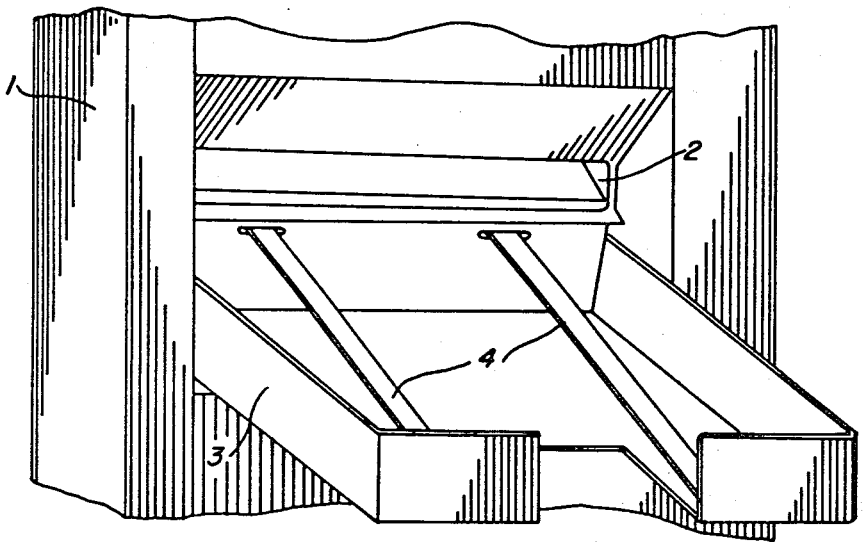
FIG. 1 is a perspective view of the apparatus.
Figure 2:
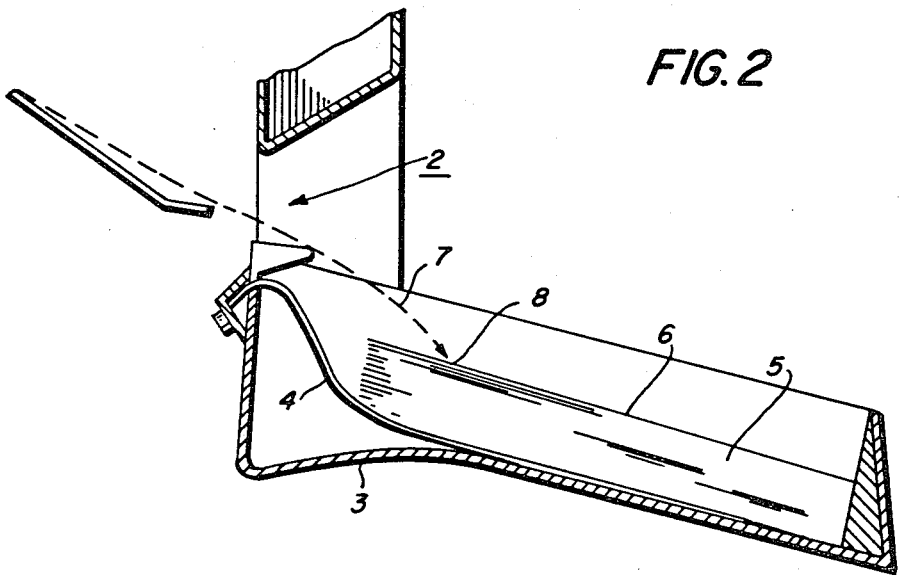
FIG. 2 is a cross-sectional view of the apparatus showing a stack of sheets or sets in the catch tray.

Referring to the drawing, a machine 1 such as a stapling machine has a sheet or set feeding arrangement (not shown) from which sheets or sets are fed by way of an exit location shown as a slot 2. A catch tray 3 is mounted on the side of the machine, below the slot 2, inclined slightly downwards away from the machine.

Mounted on the machine 1 just below the slot 2 are two strips 4 of a resilient material which extend in the feed direction of sheets being delivered. The strips 4 are of a resilient material, for example a plastics material such as Mylar (Registered Trade Mark). The thickness, width, length, height of fixing above the base of the catch tray 3, and the angle of inclination of the strips 4, are selected in conjunction with the physical characteristics of the material (for example the modulus of elasticity), such that when a stack 5 of sheets has been deliered into the tray, the uppermost sheet 6 of the stack is always at substantially the same height above the base of the catch tray 3. In this way, sheets or sets being fed out of the machine 1, as indicated by broken line 7, always first contact a support surface at about the same position 8. The first-fed sheet or set will, of course, encounter only the strips 4, but subsequent sheets or sets will encounter the immediately preceding sheet or set. Once a small stack has built up in the catch tray 3, part of the free end of each strip 4 is held by friction against the base of the catch tray due to the weight of the stack, but as the weight of the stack increases, the strips 4 gradually withdraw to allow further strip deflection with increasing stack height.

The strips 4, which are simple and inexpensive to manufacture and mount, provide a substitute for the ideal catch tray base which would automatically adjust to stack build-up and continue providing support for the stack, maintaining the desired drop height for the leading edge of fed sheets or sets. By maintaining the correct drop height for the leading edge of fed sheets or sets, it is possible to substantially eliminate curling or rolling up of sheets or sets before they are properly stacked. As a further aid to preventing curling, additional resilient strips may be mounted above the slot 2, extending generally in the feed direction, in well-known fashion.

I claim:

1. A sheet stacking apparatus comprising a device for feeding sheets from an exit location onto the stationary base portion of a catch tray positioned below the exit location, said stationary base portion being substantially planar and being inclined slightly downward away from said exit location and means for supporting sheets fed into the catch tray such that further sheets fed from the exit location will encounter substantially constant conditions, characterized in that the means for supporting sheets fed into the catch tray comprises a plurality of resilient strips secured by one end adjacent the exit location and extending in the feed direction above a part of said stationary base portion, and resilient strips directly supporting at least the trailing edges of sheets held in the catch tray thereon, said resilient strips being of such material and configuration as to be deflected by an amount substantially proportional to the weight of sheets being supported thereon.

2. The apparatus of claim 1 wherein said resilient strips are made of plastic material.

3. The apparatus of claim 2 wherein said strips extend into the catch tray such that part of the free end of each strip is frictionally held against said stationary base portion of the catch tray by sheets that have been fed into the catch tray.

* * * * *

UNITED STATES PATENT AND TRADEMARK OFFICE

CERTIFICATE OF CORRECTION

PATENT NO. : 4,364,553

DATED : December 21, 1982

INVENTOR(S) : Lionel A. Wilson

It is certified that error appears in the above-identified patent and that said Letters Patent are hereby corrected as shown below:

IN CLAIM 1:

line 55, after the phrase "of said stationary base portion", please delete the word "and" and insert - - - said - - -.

Signed and Sealed this

*Twenty-ninth* Day of *March 1983*

[SEAL]

*Attest:*

GERALD J. MOSSINGHOFF

*Attesting Officer*

*Commissioner of Patents and Trademarks*